United States Patent [19]

Bogasky

[11] Patent Number: 4,583,083

[45] Date of Patent: Apr. 15, 1986

[54] CHECKOUT STATION TO REDUCE RETAIL THEFT

[76] Inventor: John J. Bogasky, 8350 Greensboro Dr., Bldg. 1, Apartment 412, McLean, Va. 22102

[21] Appl. No.: 625,821

[22] Filed: Jun. 28, 1984

[51] Int. Cl.[4] ..... G08B 13/24

[52] U.S. Cl. ..... 340/572; 340/551; 186/52; 186/59; 186/60; 186/61

[58] Field of Search ..... 340/572, 568, 551; 186/52, 60, 61, 59

[56] References Cited

U.S. PATENT DOCUMENTS

| | | | |
|---|---|---|---|
| 3,088,544 | 5/1963 | Field | 186/60 |
| 4,063,229 | 12/1977 | Welsh et al. | 340/572 |
| 4,135,184 | 1/1979 | Pruzick | 340/572 |
| 4,139,844 | 2/1979 | Reeder | 340/572 |
| 4,254,868 | 3/1981 | Humble et al. | 206/484 |
| 4,281,321 | 7/1981 | Narlow et al. | 340/572 |
| 4,293,266 | 10/1981 | St. Lawrence et al. | 414/411 |
| 4,299,870 | 11/1981 | Humble | 428/101 |
| 4,309,697 | 1/1982 | Weaver | 340/572 |
| 4,318,090 | 3/1982 | Narlow et al. | 340/572 |
| 4,384,281 | 5/1983 | Cooper | 340/572 |
| 4,394,645 | 7/1983 | Humble et al. | 340/572 |
| 4,413,254 | 11/1983 | Pinneo et al. | 340/572 |
| 4,430,645 | 2/1984 | Eskandry et al. | 340/572 |

OTHER PUBLICATIONS

Brochure on Sensorgate Equipment.
Brochure for Sensorvision System.
Peter Berlin, Report on Shrinkage Control, Apr., 1982.
Collection of articles regarding supermarket losses or shrinkage due to shoplifting.

*Primary Examiner*—Glen R. Swann, III
*Attorney, Agent, or Firm*—Finnegan, Henderson, Farabow, Garrett & Dunner

[57] ABSTRACT

A checkout station dispossesses a shopper of items identified by the shopper for purchase, which items contain theft-prevention indicators, and then detects the presence of any of such items in the possession of the shopper after the shopper has been dispossessed of the items. After the total cost of the items is printed and paid, the shopper is returned possession of the items.

22 Claims, 10 Drawing Figures

CHECKOUT STATION TO REDUCE RETAIL THEFT

BACKGROUND OF THE INVENTION

The present invention concerns checkout stations and, more particularly, checkout stations for stores which contain items having theft-prevention indicators.

Theft in retail stores has become staggering. The impact of theft is felt not only by the retailers, but also by the consumers who bear the loss from theft either by increased prices or by store closings.

In supermarkets alone, a conservative estimate is that in 1983 theft accounted for more than one billion dollars in losses. Conventional theft detection or prevention techniques have done little to alleviate the problem. Training store personnel to detect and prevent theft is, at best, only a limited solution. Such personnel have other responsibilities, and the large number and high turnover of personnel in most stores makes it difficult to assess whether all employees are effectively spotting and preventing shoplifting.

Use of store detectives is also an inadequate solution. Store detectives are expensive, which limits the number of detectives each store can economically employ, and each store detective sees only a small part of the entire store.

The need for an effective and inexpensive technique to reduce thefts is, and has been for some time, extremely great. In many retail establishments, especially supermarkets, profits are only a small percentage of total sales; many stores' profits are less than one percent of total sales. Since such small profit margins cannot support much "set-off," the effects of theft loss in these stores is magnified.

One device which was developed to reduce supermarket theft is the SensorGate system sold by Sensormatic Electronics Corporation. In that system, soft metal strips, called labels, act as theft-prevention indicators and are attached to a store's retail items. When items with such indicators pass through a sensing gate, for example sensing gate 10 shown in FIGS. 1*a* and 1*b*, the gate detects the presence of the strip and activates an alarm. U.S. Pat. Nos. 4,394,645 to Humble et al. and 4,309,697 to Weaver, both assigned to Sensormatic Electronics, Corp., provide a more complete description of a sensing gate.

FIG. 1*b* shows a typical placement of the gate 10 relative to a conveyor belt 15 in a checkout station of a typical supermarket. The detection area 40 in FIG. 1*b* is that area through which theft-prevention indicators must pass for the gate to detect them.

Other types of sensing systems which have been developed for similar purposes electromagnetically sense, for example by radio beams, detection tags on the items to be purchased.

FIG. 2 shows a checkout station 5 in a supermarket 1. The items available for purchase from the store which are determined to be "high-theft" items have theft-prevention indicators which, as described above, include soft metal labels. Sensing gates 10, similar to the gate shown in FIGS. 1*a* and 1*b*, are placed in entrance aisle 85.

When a shopper approaches a gate 10 with a shopping basket full of items from the store, that shopper places all those items on conveyor 15. A cashier using cash register system 70, which typically includes a universal product code scanner and printer, determines the total cost of items on conveyer 15 and receives payment from the shopper for those items. Gate 10 is designed to detect any "high-theft" items remaining on the shopper's person instead of on conveyor 15 and to set off an appropriate alarm when the shopper walks through that gate.

The problems with the checkout station in FIG. 2 make its use undesirable. First, since gate 10 is sensitive to the presence of metal, it would normally set off an alarm when a shopping cart or basket is pushed through it. To avoid this, sensing gate 10 has an inhibitor which disarms the gate when an object which has a very high metal content, like a shopping cart, is near the gate. In theory, after the shopper pushes his cart through gate 10 and into checkout aisle 60, the gate closes and "re-arms," i.e., becomes active again, so when the shopper later passes through gate 10, the gate can determine whether the shopper has retained any items on his or her person.

In practice, however, it has been determined that when a shopper has a child or a pocketbook in the shopping cart, the shopper pulls the cart back in contact with gate 10 or at least into the gate's detection area, thereby disarming the system. Disarming the gate also occurs if the cashier, in loading bags onto a cart, moves the cart too close to gate 10. As a result, the system in FIG. 2 is "armed" only a small part of the time, thus reducing its effectiveness.

Also, the sensitivity of the system in FIG. 2 must be set very low to prevent false alarms from the excessive electrical noise, e.g., from scanner printers in register 70. False alarms not only slow the checkout operation but also generate shoppers' ill will toward the store.

Fire codes dictate that stores as large as grocery stores provide 60 inch openings at locations X and Y shown in FIG. 2. Present sensing technology cannot span this distance with a single system, and use of two systems creates fire code problems because of the need for a pedestal at the center of the 60 inch opening. As a result, systems are placed at 60 inch distances with no middle pedestal for deterrent purposes, but they seldom alarm because systems cannot function effectively at 60 inches.

These problems reduce the detection rate to an unacceptably low level, especially in view of the system's cost, which can be significant due to the number of systems needed and the structural changes which would be required for each checkout station.

The width of entrance aisle 85, through which the shopper with a shopping cart passes prior to entering checkout aisle 60, is typically only one or two inches wider than a shopping cart. The width of the supporting structure on gate 10, however, is more than two inches on each side, so gate 10 cannot be used in FIG. 2 without enlarging the entrance aisle. Such enlargement is estimated to cost at least $12,000 per store, and some selling space or the numbers of aisles may need to be reduced to accommodate the widened entrance aisles. The FIG. 2 system is thus both costly and ineffective.

To avoid widening the entrance aisles, a checkout station 5', shown in FIG. 3, uses a modified single gate 10' placed as shown in the checkout aisle 60. A shopper in entrance aisle 85 places items for purchase on belt 15 and pushes the shopping cart past gate 10' and into checkout aisle 60. The cashier takes the items from belt 15 and places them in the cart. Any other items containing a theft-prevention indicator would be detected by gate 10' if they remain on the shopper's person.

The problems with this system are still that gate 10' is very close to the scanner printer in the adjacent cash register station, thus requiring a lowering of sensitivity and, in the normal basket loading position, the basket cart could be in the gate detection area, thereby disarming the system. Furthermore, the cashier must make awkward and time consuming movements to load this cart.

Checkout station 5'' in FIG. 4 eliminates some of the problems of the systems in FIGS. 2 and 3, but still has some major disadvantages. In FIG. 4, gates 10 are placed in checkout aisle 60 far enough back to avoid interference from adjacent scanner printers. A shopper entering a checkout aisle proceeds as in the systems in FIGS. 2 and 3. At the checkout station, however, when the cashier places the bags into the shopper's cart, the cart may contact and disarm the gates. Cashiers could make sure the carts are pushed all the way through the gate after loading them and before the shopper passes through the gate, but this requires that the cashiers all be trained and constantly supervised to ensure that they follow this very important procedure.

An objective of the present invention is, therefore, a checkout station to reduce the amount of theft from a store.

Another objective of the present invention is a checkout station to reduce theft which requires minimal redesign of existing checkout stations.

A further objective of the present invention is a checkout method which allows the use of self-checkout stations while reducing theft in retail establishments.

Another objective is a checkout station which does not require aisles to be moved, which eliminates congestion, and which reduces the number of theft-prevention systems required per store.

Another objective is high-speed checkout and self-checkout which requires fewer cashiers and checkout aisles and yield more sales space.

Another objective is to increase sensor sensitivity by reducing interference and to obtain a higher pick rate with fewer or no false alarms in order to have greater deterrent effect and apprehension identification potential.

Another objective is an effective theft prevention system in accord with the fire codes.

Yet another objective of the present invention is an automated checkout station.

SUMMARY OF THE INVENTION

The checkout station of this invention attains these objectives and overcomes the problems of the prior art by separating shoppers from items to be purchased while shoppers pass through a sensing gate, which can be set to a high sensitivity because of the location of the gate.

More specifically, the checkout station of this invention comprises means through which a shopper must pass to leave the store for dispossessing the shopper from the items from the store identified by the shopper for purchase, the items containing theft-prevention indicators; sensing means for detecting the presence of items with the theft-prevention indicators in possession of the shopper after the shopper has been dispossessed of the items identified for purchase; cashier stations, separated from the sensing means, for printing the total cost of the items identified by the shopper for purchase and for receiving payment from said shopper corresponding to said total cost after the items identified for purchase have been dispossessed from the shopper; and a pickup area wherein the shopper is returned possession of the items identified for purchase after the total cost of the items identified for purchase has been printed.

The method of this invention for reducing theft from a store containing items with theft-prevention indicators comprises the following steps: dispossessing shoppers of items identified by the shopper for purchase; detecting the presence of items with the theft prevention indicators in the possession of the shopper after the shopper has been dispossessed of the items identified for purchase; printing the total cost of the items identified by the shopper for purchase at a location separated from where the detecting step takes place; and giving the shopper possession of the items identified for purchase after store payment for the identified items has been received.

The accompanying drawings, which are incorporated in and constitute a part of this specification, illustrate embodiments of the invention and, together with the description, explain the principles of the invention.

DESCRIPTION OF THE PREFERRED EMBODIMENTS

Reference will now be made in detail to presently preferred embodiments of the invention, examples of which are illustrated in the accompanying drawings.

Figure 5:
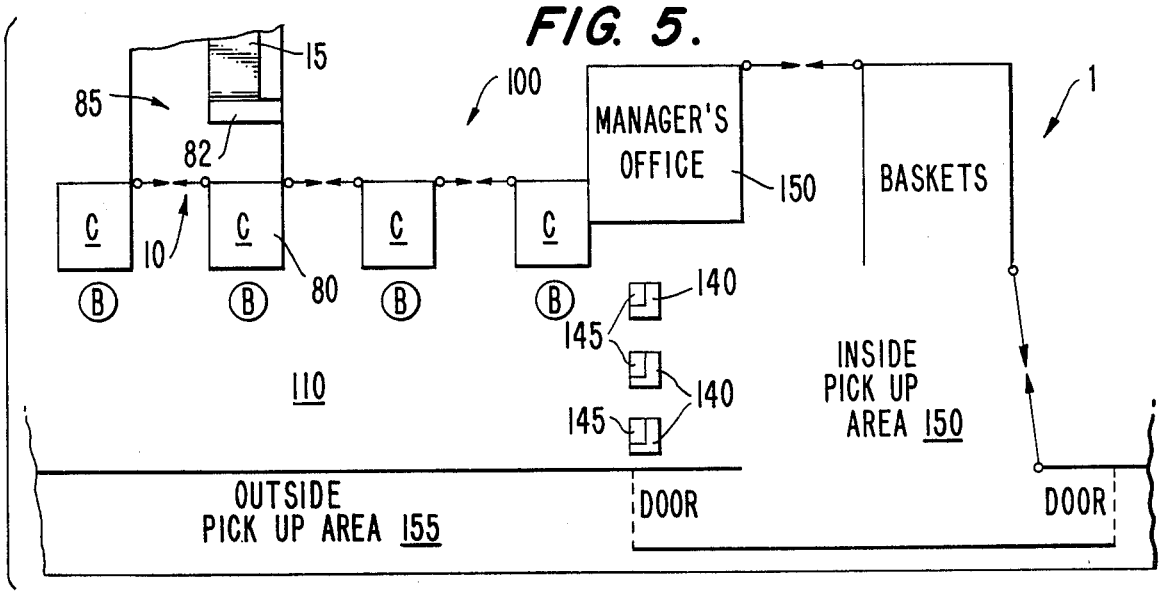
FIG. 5 shows a supermarket checkout station in accordance with the present invention.

FIG. 5 shows an embodiment of the present invention for a checkout station to reduce theft from a store. Elements of the checkout station which have been described previously are identified by like reference numerals and will not be further discussed.

As in the systems described previously, a shopper gathers from store 1 items which are available for purchase from the store and which have theft-prevention indicators. The shopper usually puts those items in a carrying basket or shopping cart and, when finished shopping, enters the checkout station identified generally by 100. The purpose of checkout station 100 is to detect any items which the shopper has not identified for purchase, but with which the shopper intends to leave the store without paying. The shopper enters checkout station 100 via checkout aisle 85.

In accordance with the present invention, there are means through which a shopper must pass to leave the store for dispossessing the shopper of those items which the shopper identifies for purchase. In the checkout station in FIG. 5, the dispossessing means includes conveyor 15, bag console 80 and secure area 110 located adjacent to console 80.

Figure 1A:
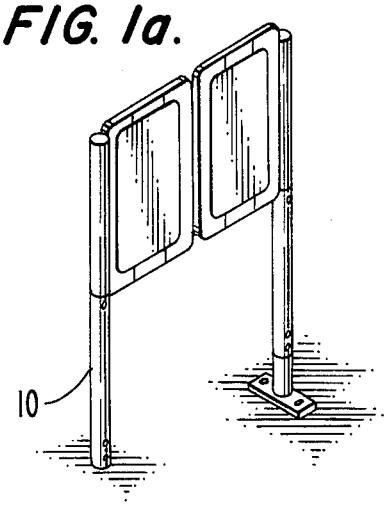
FIG. 1*a* shows a perspective view of a sensing gate which can be used with this invention.
Figure 1B:
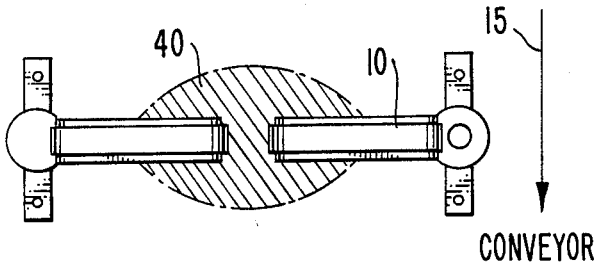
FIG. 1*b* shows the top view of the sensing gate in FIG. 1*a;*

Also in accordance with the present invention, there is sensing means for detecting the presence of items with the theft-prevention indicators which are in the possession of the shopper after the shopper has been dispossessed of the items identified for purchase. In FIG. 5, this means includes sensing gate 10 which is located adjacent to bag console 80. Because sensing gate 10 is no longer in checkout aisle 85, gate 10 can be the standard sensing gate shown in FIGS. 1*a* and 1*b* which is recessed into console 80 and an adjacent console.

The checkout station of this invention also includes cashier stations for printing the total cost of the items identified by the shopper for purchase and for receiving payment from said shopper corresponding to said total cost after such items have been dispossessed from the shopper. To avoid the interference problems, and corresponding low sensitivity, present in the prior art systems, such cashier stations are separated from the sensing means. In FIG. 5, cashier stations 140 each contain a cash register 145 similar to cash register 70 in FIGS. 2–4, which prints the total cost of the items identified for purchase and which receives payment for said items. In the system in FIG. 5, cashier stations 140 are located adjacent secure area 110 such that secure area 110 is between the bag consoles 80 and the cashier stations 140.

Preferably, scanner 82 reads codes, like the Universal Product Code, on items identified for purchase to compute their price. In the present invention, this information would be sent to cash register station 140 for printing of each item's price and the items' total cost. Scanner 82 is, in one embodiment, used by a store employee who passes the items over the scanner 82. The store employee could, for example, be a bag boy.

To increase the throughput of the checkout station 100 in FIG. 5 even more, scanner 82 can be used by the shopper, thereby creating a self-checkout station. After the items pass over scanner 82, they are placed on bag console 80. When all the items have passed through the self-checkout equipment, that equipment computes a total cost for the items which is printed at the cashier station.

Preferably bag boys (B in FIG. 5) would place the items on the console into bags both to speed the checkout and to help with self-checkout. The advantage of using self-checkout stations in this invention is that the cashiers at station 140 only need to receive the money for the items identified for purchase since the total cost of the items has already been computed and printed. Such a system could also improve aisle production and reduce the total number of cashiers needed in the store.

The present invention is particularly advantageous for use with self-checkout stations since the checkout station of this invention will reduce theft that other self-checkout stations may experience due to the lack of cashier supervision. Since the self-checkout stations compute the total cost of the items before the shopper reaches the cashier's station, area 110 need not be under such great supervision because gate 10 will prevent the shopper from leaving the store with items that have not been scanned. Bag boys can provide all the supervision that is necessary to ensure that the shopper scans all items before they are placed on the console. In addition, the present invention is consistent with the trend towards greater automation reflected by self-checkout stations.

After the total cost of the items is printed and payment is received, the shopper is returned possession of the items identified for purchase in a pickup area, which in FIG. 5 can be inside pickup area 150, located adjacent cash register stations 145 or outside pickup area 155.

In operation without self-checkout, after entering checkout station 100 via checkout aisle 85, a shopper places the items identified for purchase onto conveyor 15. A store employee passes the items over a scanner 82 and places them onto console 80. A bag boy B would then take the items identified for purchase and either place them in bags or in another cart and then move the cart or bags to one of cashier stations 145.

The shopper, with or without self-checkout, places all the items in the cart or basket onto conveyer 15. A bag boy B then pulls the cart or basket completely through sensing gate 10 while, for example, the items are still being scanned. The shopper then walks through gate 10 without the shopping cart or basket, when gate 10 is fully rearmed.

Also, because gate 10 is not adjacent any cash registers or scanner printers, the gate's sensitivity can be made high to detect with high reliability the presence of items having the theft-prevention indicators if such items remain with the shopper when walking through sensing gate 10. Shoppers thus will not be able to conceal on their person or in their accessories, such as their handbags, any items containing the theft-prevention indicators.

At station 140, a cashier, having the total cost printed, receives payment from the shopper corresponding to that cost. The shopper is then given possession of such items and may leave the store.

One advantage of the embodiment of the invention shown in FIG. 5 is that it uses presently-known sensing gate technology and enhances the value of that technology by increasing the gates' sensitivity to theft-prevention devices. The efficacy of the system is increased further since the shopping carts are not loaded by the cashier, so there is no reason for shoppers to pull them back into the sensing gate and disarm the gate. Also, self-checkout needs only minimal supervision, e.g., by bag boys or by personnel in the manager's office 150, to ensure that shoppers pass all items over the scanner.

Figure 2:
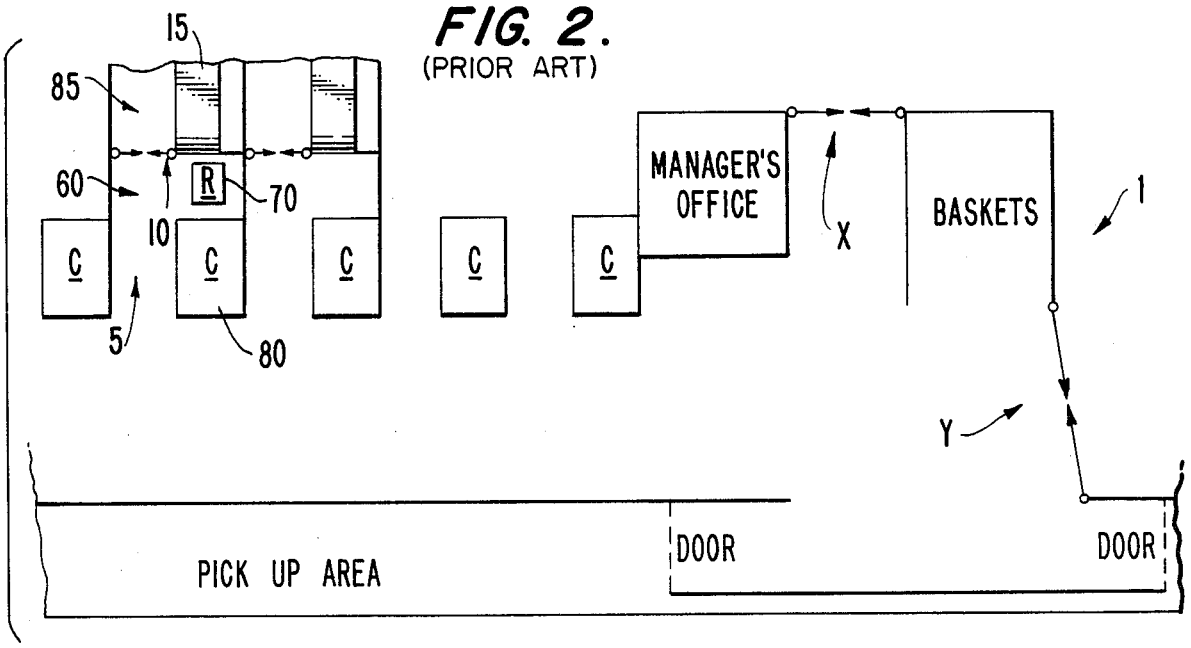
FIG. 2. (PRIOR ART)
FIG. 2 shows a supermarket checkout station using the gate shown in FIGS. 1*a* and 1*b;*
Figure 3:
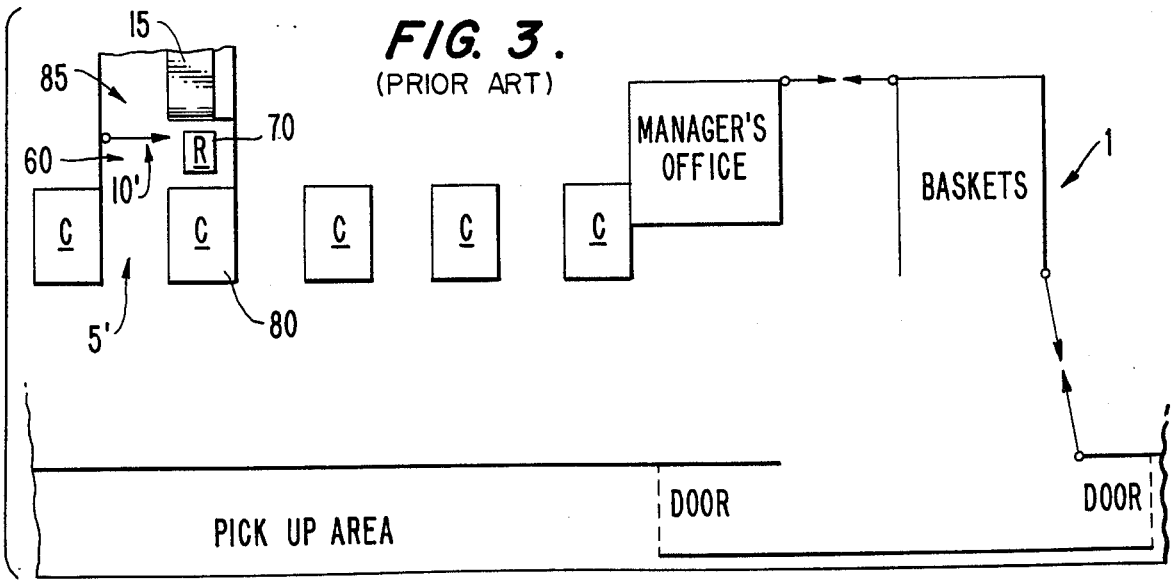
FIG. 3. (PRIOR ART)
FIG. 3 shows another supermarket checkout station using a modified sensing gate.
Figure 4:
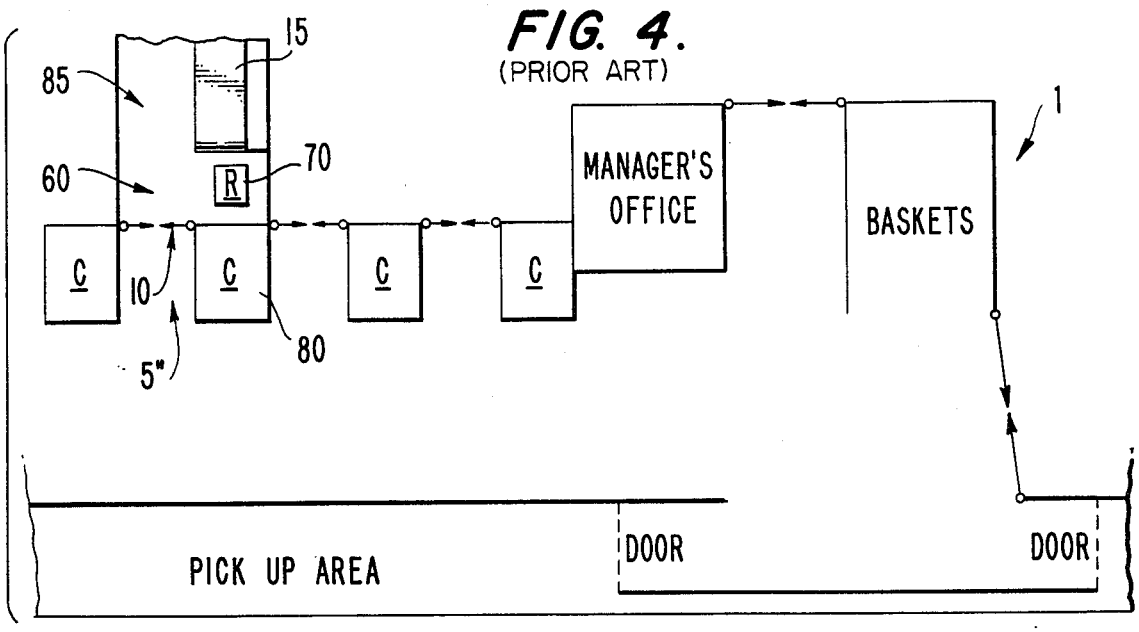
FIG. 4. (PRIOR ART)
FIG. 4 shows another supermarket checkout station using the sensing gate shown in FIGS. 1*a* and 1*b;*

Because checkout aisles 85 need not be widened, the cost for installing the checkout station shown in FIG. 5 is much less than that of the systems in FIGS. 2–4. Also, since the checkout aisles' throughput will be increased by moving the cashier operation from the checkout aisles and bag consoles, additional sales space may be gained by removal of one or more checkout aisles.

Figure 6:
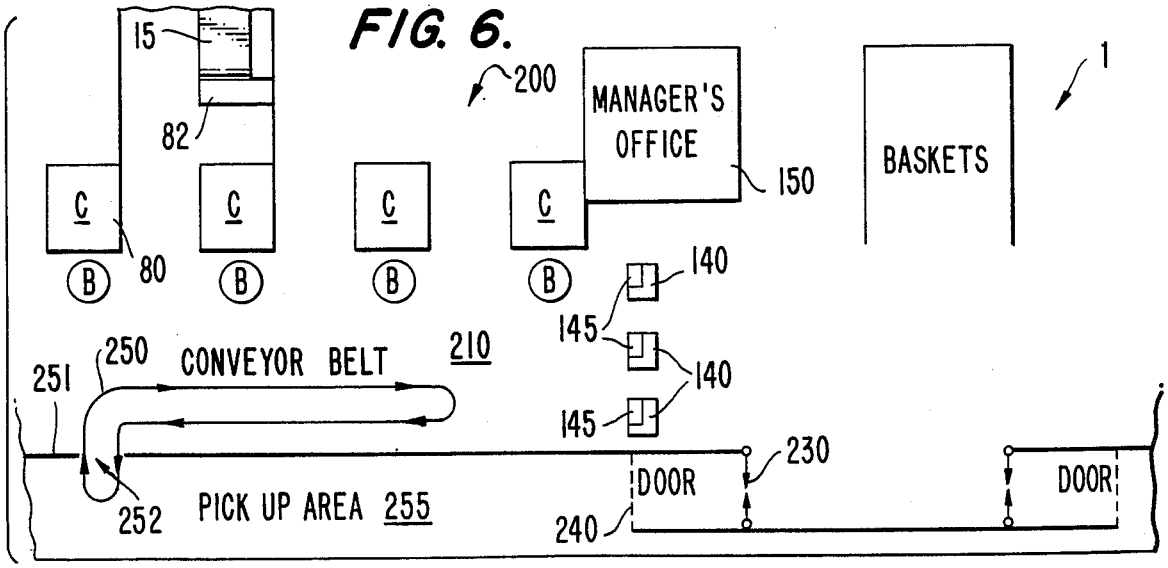
FIG. 6 shows another supermarket checkout station in accordance with the present invention.

FIG. 6 shows another embodiment of the present invention. The checkout station of this invention can further include egress means, adjacent to the secure area, for removing items identified for purchase from the store. As shown in FIG. 6, such means includes conveyor 250 located adjacent to secure area 210. Conveyor 250 is an endless-loop conveyor in which the carrying surface of the conveyor, which can either be a belt or interlocking sections such as are used for transporting luggage in airports, remains parallel to the floor.

As shown in FIG. 6, portions of conveyor 250 lie within store 1, and portions lie outside of store 1 in pickup area 255.

The present invention can also include means for providing an exit for the shopper from the store without the items identified for purchase. As shown in FIG. 6, such exit means includes door 240 which leads from store 1 into pickup area 255. In the checkout station in FIG. 6, the sensing means, shown by gate 230, is located just before the shopper exit means.

In the operation of checkout station 200, the shopper puts the items to be purchased onto belt 15, where they are then read by scanner 82 and sent to console 80 for bagging by bag boy B. Preferably, the total cost of the items is either determined at console 80 by means of a self-checkout station or is computed by a cashier.

After the total cost of the items is computed, the items identified for purchase are placed on conveyor 250 and, via opening 252 in wall 251, transported into pickup area 255 where the shopper would pick up the items. Preferably, in pickup area 255, an employee of the store would remove the items from conveyor belt 250 so they did not reenter the store before the shopper could retrieve them.

The shopper, still separated from the items to be purchased, would proceed past cashier stations 140, pay the cashier for the items purchased, and leave store 1 through door 240. Before leaving through door 240, however, the shopper would pass through gate 230 which would then detect any items still in the possession of the shopper which had the theft identification device. Such items would not have been paid for, because all purchased items would have already been placed on conveyor 250. In this way, theft from store 1 could be reduced significantly.

The advantages of the station in FIG. 6 include reduced cost due to the station's requirement for fewer sensing gate systems and the placement of those systems only at the store exits. Also, the sensitivity of the sensing gate can be greater with the system in FIG. 6 than with even the FIG. 5 system because there are fewer sources of interferences or causes of false alarms at the exit. Furthermore, in addition to the advantages discussed with regard to FIG. 5, an advantage of the checkout station in FIG. 6 is that carts or baskets need not clutter the aisles at the cashier stations and need not leave the store.

Figure 7:
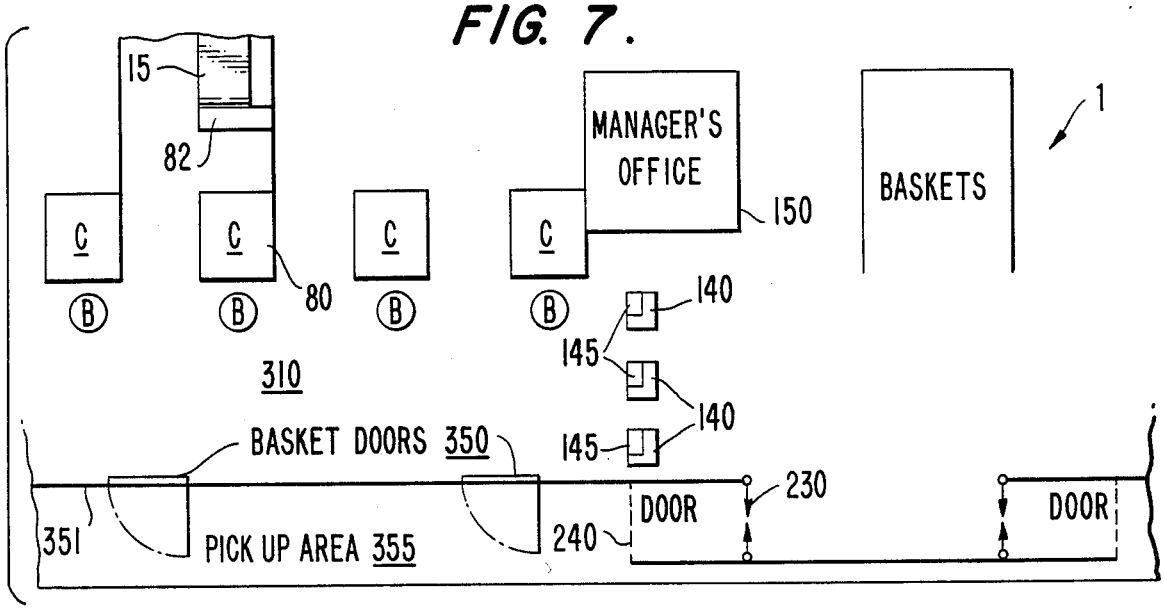
FIG. 7 shows yet another supermarket checkout station in accordance with the present invention.

Another embodiment of the present invention, shown in FIG. 7, uses basket doors 350 in outer wall 351 of store 1 to provide egress means for removing the items identified for purchase from the store. As shown in FIG. 7, basket doors 350 lead from secure area 310 to the pickup area 355.

In addition to the advantages listed of the embodiment in FIG. 6, the basket doors 350 are relatively inexpensive and basket carts can leave secure area 310, thus reducing congestion in that area.

Figure 8:
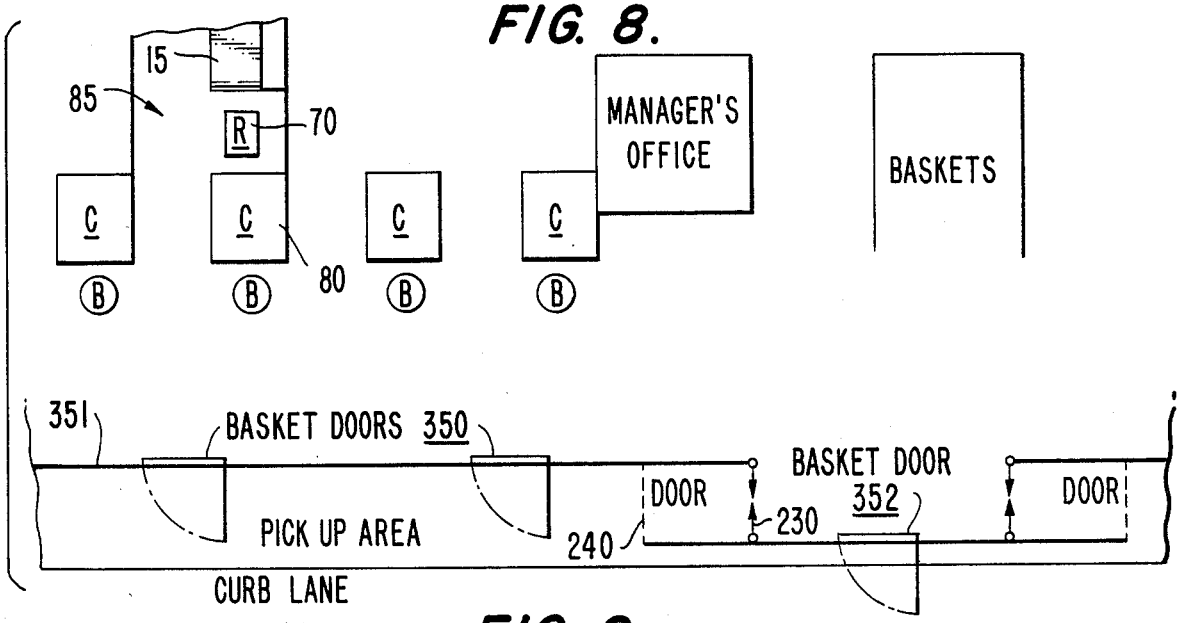
FIG. 8 shows another supermarket checkout station in accordance with the present invention.

FIG. 8, which is another embodiment of the invention, further illustrates the flexibility of this invention. In this invention, conveyor 15, aisle 85, register 70 and console 80 are as shown in FIG. 4, and in the way most supermarkets are presently configured. In addition, basket doors 350 in wall 351 and sensing gate 230 operate as shown in FIG. 7. There can also be an optional basket door 352 which operates in the same manner as basket door 350.

In operation, a shopper, as in conventional supermarkets, places items to be purchased on a conveyor belt 15. A cashier at register 70 determines the total cost of such items and places such items on the console 80. A bag boy at console 80 places all such items into bags, places the bags into shopping carts and then pushes the carts through basket doors 350 or 352.

The shopper pays for the items purchased at register 70 and leaves through door 240 via gate 230. If the shopper has concealed on his or her person any items containing a theft-prevention indicator, gate 230 will detect such items.

The advantages of the system in FIG. 8 include all the advantages indicated above with regard to the system shown in FIG. 7. In addition, the embodiment of the invention in FIG. 8 requires the least amount of redesign with the maximum sensitivity.

Although FIGS. 5–8 show different embodiments of the invention, it is possible that a store can embody any combination of those concepts. For example, a conveyor and basket doors can be used with the checkout station in FIG. 5, or both basket doors and a conveyor can be used simultaneously.

Figure 9:
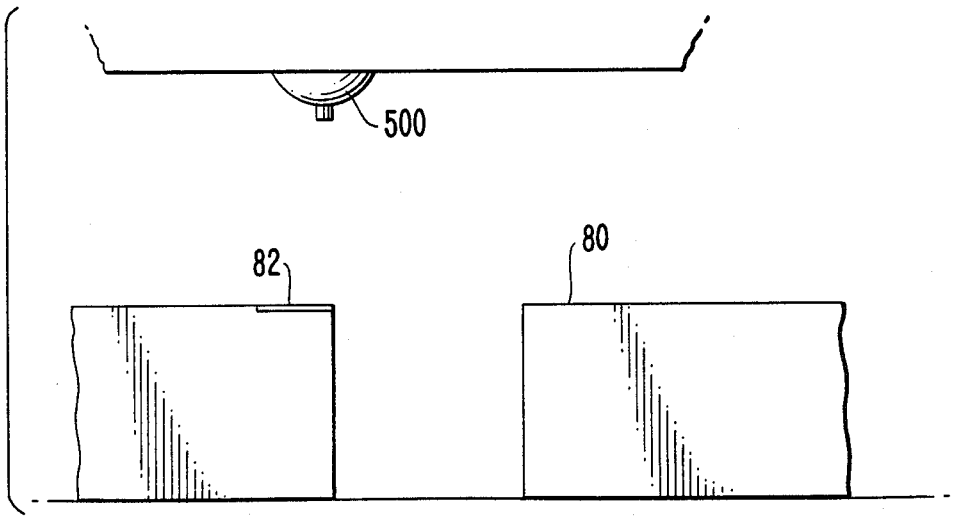
FIG. 9 shows a video camera which can be used with the checkout system of this invention.

To enhance the checkout stations of this invention further, a video camera may be added above the scanner. This camera would be coupled to a monitor, for example, in the manager's office. The camera and monitor augment the store's supervision of the scanner and relieve the bag boys of the responsibility of watching the customers at the scanner. FIG. 9 shows a camera 500 positioned over a scanner 82. One camera can be used for each scanner or a single camera can pan many scanners. An example of a camera and monitor which can be used in accordance with the present invention is the Sensor Vision TM Video System from Sensormatic Electronics Corp. Camera 500 can be used with any of the embodiments of the checkout station of the present invention, but the camera is particularly advantageous when self-checkout is used because the present invention allows the use of self-checkout and a camera to maximize automation of checkout stations.

It will be apparent to those skilled in the art that modifications and variations can be made in the checkout stations methods and apparatus of this invention. This invention in its broader aspect is not limited to the specific details, representative methods and apparatus, and illustrative examples shown and described. Accordingly, departure may be made from such details without departing from the spirit or scope of the general inventive concept.

What is claimed is:

1. A checkout station for reducing theft from a store containing items bearing theft prevention indicators, said checkout station comprising:

means, through which a shopper must pass to leave said store, for dispossessing said shopper from those of said items bearing said theft prevention indicators which said shopper designates for purchase;

a secure area into which said shopper and said items identified for purchase enter after said items identified for purchase have been dispossessed from said shopper;

a pickup area in which said items identified for purchase are returned to the possession of said shopper;

egress means, located between said secure area and said pick-up area, for removing said items identified for purchase from said secure area without said shopper; and exit means, located between said secure area and said pick-up area, for permitting said shopper to leave said secure area without said items designated for purchase, said exit means including sensing means for detecting the presence of any items bearing theft prevention indicators remaining with said shopper as said shopper leaves said secure area through said exit means.

2. The checkout station in claim 1 wherein said dispossessing means includes a console onto which said items designated for purchase are placed.

3. The checkout station in claim 2 further including self-checkout means.

4. The checkout station in claim 2 further including a scanner adjacent said dispossessing means for reading information on said items identified for purchase to determine the total cost, and a video camera mounted above said scanner.

5. The checkout station in claim 1 wherein said egress means includes a conveyer system operating between the interior and exterior of said store to carry said items identified for purchase out of said store.

6. The checkout station in claim 5 further including self-checkout means.

7. The checkout station in claim 1 further including a scanner adjacent said dispossessing means for reading information on said items identified for purchase to determine the total cost, and a video camera mounted above said scanner.

8. The checkout station in claim 1 wherein said egress means includes basket doors in an exterior wall of said store.

9. The checkout station in claim 1 further including self-checkout means.

10. The checkout station in claim 1 further including a scanner adjacent said dispossessing means for reading information on said items identified for purchase to determine the total cost, and a video camera mounted above said scanner.

11. The checkout station of claim 1 wherein said store is a supermarket.

12. The checkout station of claim 1 further including cashier stations located in said secure area for printing the total cost of said items designated for purchase by said shopper.

13. The checkout station in claim 12 wherein each said cashier station includes a cash register.

14. A method for reducing theft from a store containing items with theft preventing indicators, said method comprising the steps of:

dispossessing a shopper from those of said items bearing theft prevention indicators which said shopper designates for purchase;

passing said items identified for purchase by said shopper out of a secure area and into a pickup area without said shopper;

detecting the presence of any said items with said theft prevention indicators still in the possession of said shopper after said shopper has been dispossessed of said items identified for purchase and before said shopper enters said pickup area; and giving possession of said items identified for purchase to said shopper in said pickup area.

15. The method in claim 14 wherein said detecting step includes the step of magnetically sensing soft metal strips on said items identified for purchase.

16. The method of claim 14 wherein said detecting step includes the step of electromagnetically sensing detection tags on said items identified for purchase.

17. The method of claim 14 wherein said dispossessing step includes the step of placing said items identified for purchase on a bag console.

18. The method of claim 14 wherein said dispossessing step includes the step of removing said items identified for purchase from said store via a conveyer.

19. The method of claim 14 wherein said dispossessing step includes the step of removing said items identified for purchase from said store via basket doors.

20. The method of claim 14 further including the step of viewing, by a video camera, a scanner which reads information on said items identified for purchase to determine said total cost to be printed.

21. The method of claim 14 further including the step of determining the total cost of said items identified by said shopper for purchase.

22. The method of claim 21 wherein said cost determining steps includes the step of automatically determining said cost by said shopper using a self-checkout technique.

* * * * *